US012226013B2

(12) United States Patent
Ill

(10) Patent No.: US 12,226,013 B2
(45) Date of Patent: Feb. 18, 2025

(54) DIFFERENTIAL DRAWER SLIDE FOR FURNITURE PARTS THAT CAN BE PULLED OUT

(71) Applicant: FULTERER AG & CO KG, Lustenau (AT)

(72) Inventor: Bernhard Ill, Hohenweiler (AT)

(73) Assignee: FULTERER AG & CO KG, Lustenau (AT)

( * ) Notice: Subject to any disclaimer, the term of this patent is extended or adjusted under 35 U.S.C. 154(b) by 86 days.

(21) Appl. No.: 18/038,771

(22) PCT Filed: Sep. 20, 2021

(86) PCT No.: PCT/EP2021/075825
§ 371 (c)(1),
(2) Date: May 25, 2023

(87) PCT Pub. No.: WO2022/111878
PCT Pub. Date: Jun. 2, 2022

(65) Prior Publication Data

US 2024/0032690 A1 Feb. 1, 2024

(30) Foreign Application Priority Data

Nov. 27, 2020 (AT) ..... A 258/2020

(51) Int. Cl.
*A47B 88/493* (2017.01)
*A47B 88/447* (2017.01)
(Continued)

(52) U.S. Cl.
CPC ..... *A47B 88/493* (2017.01); *A47B 88/447* (2017.01); *A47B 88/477* (2017.01);
(Continued)

(58) Field of Classification Search
CPC ... A47B 88/493; A47B 88/447; A47B 88/487; A47B 88/477; A47B 88/57;
(Continued)

(56) References Cited

U.S. PATENT DOCUMENTS

2010/0027923 A1* 2/2010 Bonat ..... A47B 88/467 384/55
2022/0039552 A1* 2/2022 Moscoso ..... A47B 88/487
(Continued)

FOREIGN PATENT DOCUMENTS

EP 1795088 A1 6/2007
EP 3498131 A1 6/2019
(Continued)

OTHER PUBLICATIONS

International Search Report (ISR) and Written Opinion (WO) for International Application No. PCT/EP2021/075825 mailed Jan. 7, 2022, 12 pages (English Translation Attached).

*Primary Examiner* — Kimberley S Wright
(74) *Attorney, Agent, or Firm* — Dickinson Wright PLLC

(57) ABSTRACT

A differential drawer slide for furniture parts that can be pulled out is provided. The differential drawer slide includes a body rail, a pull-out rail and a central rail. An adjusting part of the central rail is mounted so as to be adjustable between a release position, in which the central rail can be tilted with respect to the body rail and a stop surface of the central rail can be moved past the body rail, under a stop element of the body rail, and a blocked position. A lateral guide roller is rotatably mounted on the adjustment part (13) and interacts with a vertical web (**3*d***) of the body rail. The central rail is shorter than the body rail and the pull-out rail.

10 Claims, 6 Drawing Sheets

(51) Int. Cl.

| | |
|---|---|
| ***A47B 88/477*** | (2017.01) |
| ***A47B 88/487*** | (2017.01) |
| ***A47B 88/57*** | (2017.01) |
| *A47B 88/407* | (2017.01) |
| *A47B 88/423* | (2017.01) |
| *A47B 88/433* | (2017.01) |

(52) U.S. Cl.
CPC ..... *A47B 88/487* (2017.01); *A47B 88/57* (2017.01); *A47B 88/407* (2017.01); *A47B 2088/4235* (2017.01); *A47B 88/433* (2017.01)

(58) Field of Classification Search
CPC ..... A47B 88/407; A47B 88/433; A47B 2088/423; A47B 2088/0043
See application file for complete search history.

(56) References Cited

U.S. PATENT DOCUMENTS

2023/0380592 A1* 11/2023 Ill ..... A47B 88/493
2023/0404259 A1* 12/2023 Ill ..... A47B 88/423

FOREIGN PATENT DOCUMENTS

WO 2008119091 A1 10/2008
WO 2015024032 A1 2/2015

* cited by examiner

Fig. 13
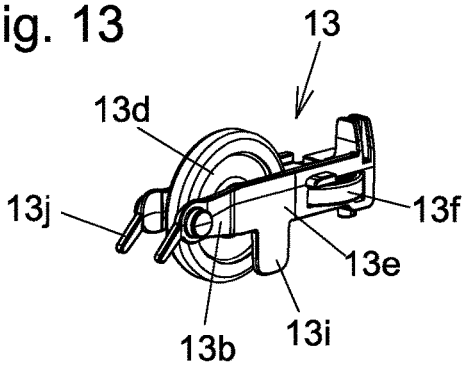
Fig. 15
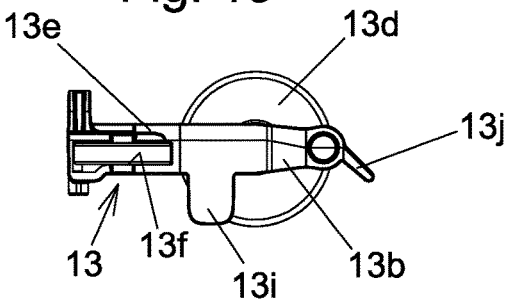
Fig. 14
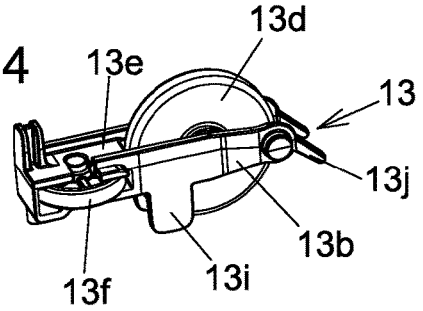
Fig. 16
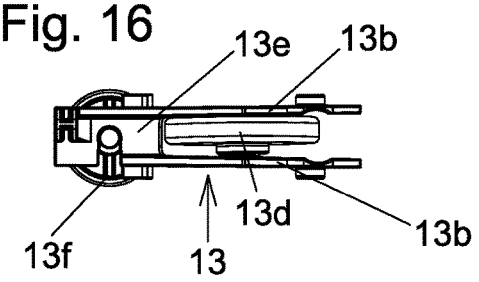
Fig. 17
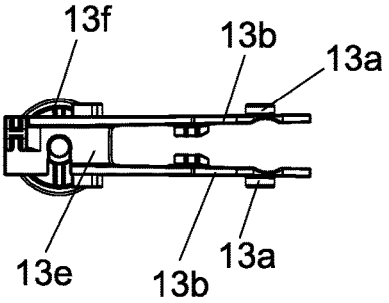
Fig. 19
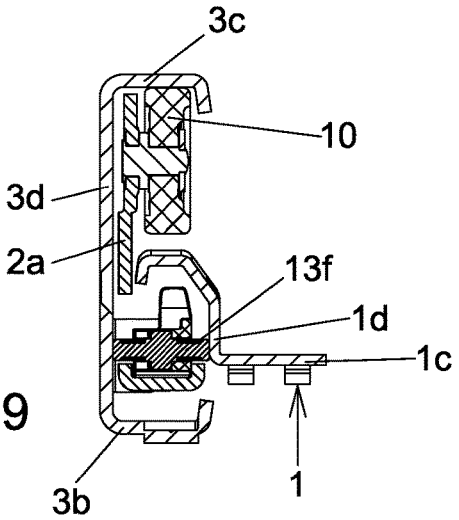
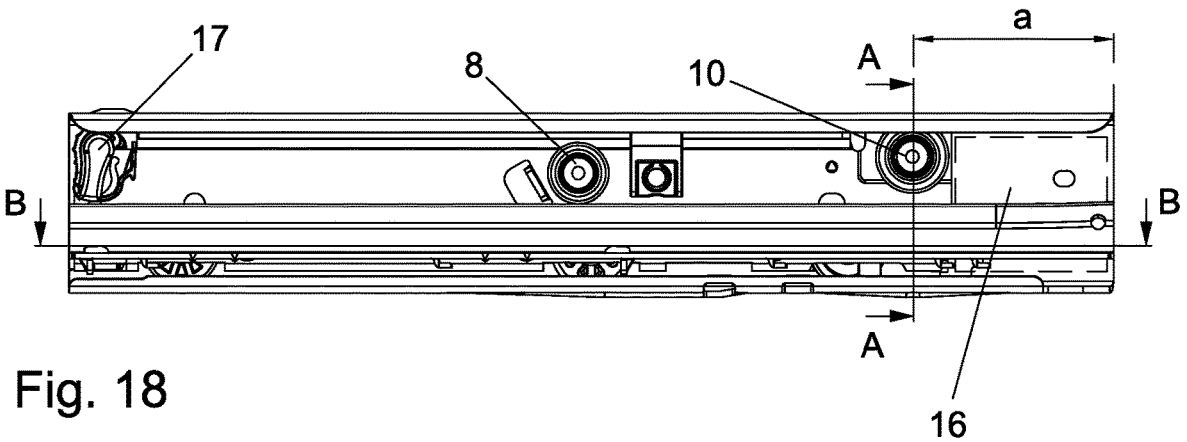
Fig. 18

Fig. 25
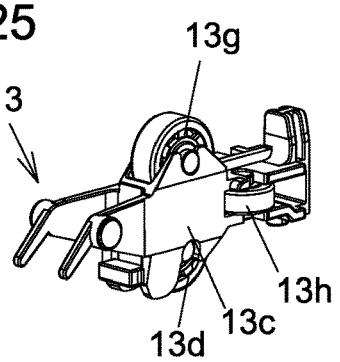
Fig. 27
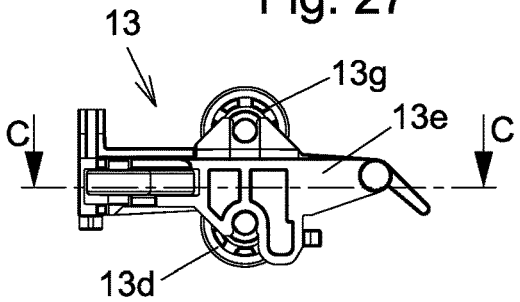
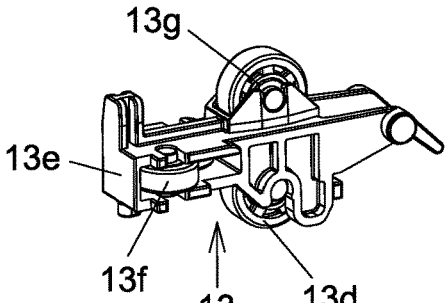
Fig. 26
Fig. 28
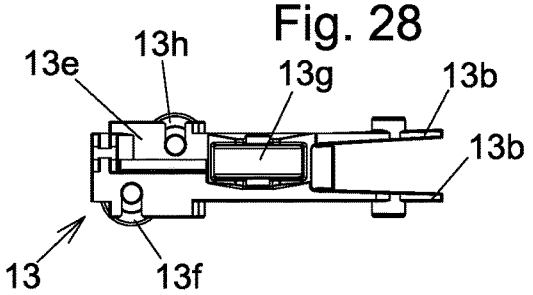
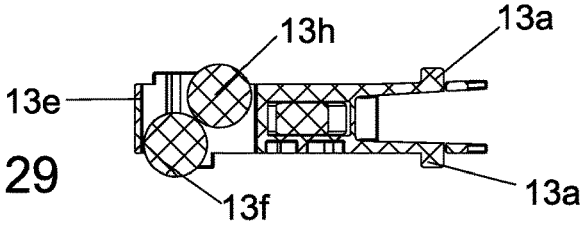
Fig. 29
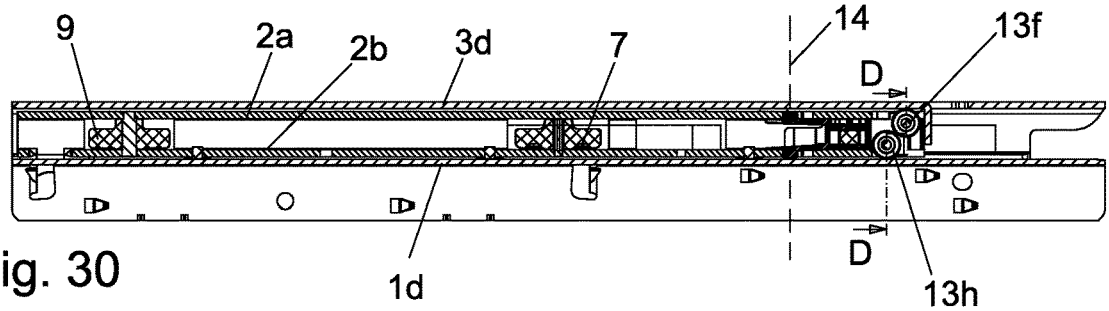
Fig. 30
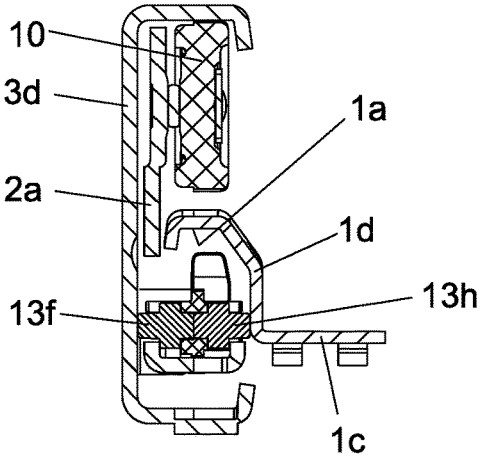
Fig. 31

DIFFERENTIAL DRAWER SLIDE FOR FURNITURE PARTS THAT CAN BE PULLED OUT

This U.S. patent application is a national phase entry of international patent application no. PCT/EP2021/075825, filed Sep. 20, 2021, which claims priority to Austrian patent application no. A 258/2020, filed Nov. 27, 2020, the entire contents of which are incorporated herein by reference in their entirety.

BACKGROUND

1. Technical Field

The invention relates to differential drawer slide for furniture parts that can be pulled out, comprising a body rail that can be attached to a furniture body, a pull-out rail that can be attached to a pull-out furniture part and a central rail arranged between the body rail and the pull-out rail, wherein the pull-out rail and the central rail can be pulled out starting from a closed position of the differential drawer slide into an open position of the differential drawer slide in a pull-out direction and the pulling out of the central rail from the body rail in the open position of the differential drawer slide is limited by a stop element of the body rail to which a stop surface of the central rail approaches, wherein on the central rail in the region of the rear end of the central rail an adjustment part is mounted adjustably between a release position in which the central rail can be tilted with respect to the body rail about a horizontal axis located at right angles to the pull-out direction of the central rail from a normal position into a tilt position in which its rear end is lowered with respect to the normal position and for removal of the central rail from the body rail, the stop surface of the central rail can be guided past the body rail under the stop element of the body rail, and a locking position in which the central rail is blocked from any tilting from the normal position into the tilt position, and wherein a lateral guide roller is rotatably mounted on a base body of the adjustment part, which lateral guide roller cooperates with a vertical web of the body rail.

2. Related Art

A differential drawer slide of the type mentioned initially is deduced from EP 1 795 088 B1. In such differential drawer slides, when pulling out the pull-out rail, the central rail moves synchronously with the pull-out rail, wherein this covers half the distance of the pull-out rail in each case. In particular, the central rail has a load-transmitting differential roller for this purpose which rolls between tracks of the pull-out rail and the body rail. Usually, all the rollers of the pull-out guide are rotatably mounted on the central rail here.

Pulling out the drawer slide is limited in an open position of the drawer slide by stops, likewise the pushing together of the drawer slide in a closed position of the drawer slide is limited by stops. In order to limit the pulling-out of the central rail from the body rail, the body rail has a stop element to which a stop surface of the central rail approaches in the pulled-out state of the central rail. An adjustment part arranged in the region of the rear end of the central rail which is adjustably mounted between a release position and a locking position, is used to enable a removal of the central rail from the body rail or to block such a removal. In the release position of the adjustment part, the central rail can be tilted with respect to the body rail about a horizontal axis at right angles to the pull-out direction of the central rail from a normal position into a tilt position. In the tilt position the rear end of the central rail is lowered with respect to the normal position. As a result, the stop surface of the central rail under the stop element of the body rail can be guided past this and the central rail can be completely removed from the body rail. In the locking position of the adjustment part the central rail is blocked from any tipping from the normal position into the tilt position so that removal of the central rail from the body rail is blocked. On the adjustment part a roller is mounted rotatably about a horizontal axis at right angles to the pull-out direction, which cooperates with an upwardly directed track of the body rail. If, in the locking position of the adjustment part, an attempt is made to tilt the central rail from the normal position into the tilt position, this roller of the adjustment part is pressed against the track of the body rail whereby tilting is blocked. In the release position on the other hand, the adjustment part can pivot against a horizontal axis at right angles to the pull-out direction. In addition, a lateral guide roller is rotatably mounted on the adjustment part which cooperates with a vertical web of the body rail. The lateral stability of the drawer slide with respect to a loading of the central rail towards the side directed away from the vertical web of the body rail is thereby improved, in particular in the open state of the drawer slide.

Further known are drawer slides with self-retracting devices in which the pull-out rail is automatically retracted over a last section of the insertion path. It is advantageous if such self-retracting devices are integrated in the drawer slide. A drawer slide with integrated self-retracting device is known, for example from WO 2008/119091 A1. In order to create space for integration of the self-retracting device, the central rail has a cut-out over a part of its height in the region of its rear end. Located above this cut-out at the rear end of the central rail as usual is a roller which cooperates with a downwardly directed track of the body rail. Located in front of this cut-out is an auxiliary roller which cooperates with the same tracks as the differential roller and which, in the inserted state of the drawer slide, can prevent any downwards tilting of the rear end of the central rail and the rear end of the drawer slide, as is also usually the case with different drawer slides. As a result of the cut-out of the central rail located behind the auxiliary roller, it is not possible to attach an adjustment part at this point which is adjustable between a release position and a locking position and in the release position, enables a tilting of the central rail from a normal position into a tilting position in order to remove the central rail from the body rail and in the locking position blocks such tilting. A stop element arranged on the central rail is therefore adjustable itself between an active position in which it cooperates with a stop element of the body rail in order to limit the pulling-out of the central rail from the body rail, and a passive position in which it is disengaged from the stop element of the body rail in order to allow the complete removal of the central rail from the body rail. However, the configuration of an adjustable stop element is disadvantageous with regard to operation, construction and durability. In addition, as a result of the cut-out located at the rear end of the central rail only in a lower part of the central rail, the possible overall height of a self-retracting device is accordingly limited so that there are limitations with regard to the configuration of the self-retracting device. However, if the central rail were shortened overall, the lateral stability of the drawer slide would be reduced.

SUMMARY

It is the object of the invention to provide an advantageous differential drawer slide of the type mentioned initially which in the region of the rear end of the body rail has the largest possible installation space for fitting the drawer slide with a self-retracting device. According to the invention, this is achieved by a differential drawer slide having the features of Claim 1.

In the differential drawer slide according to the invention, the central rail is configured to be shorter than the body rail and shorter than the pull-out rail and in the inserted state of the differential drawer slide, the rear end of the central rail is offset towards the front with respect to the rear end of the body rail and with respect to the rear end of the pull-out rail. The lateral guide roller of the adjustment part located in the region of the rear end of the central rail cooperates not only with the vertical web of the body rail but also cooperates on the opposite side of the adjustment part to the vertical web of the body rail with a vertical web of the pull-out rail or that on the base body of the adjustment part, an additional lateral guide roller is rotatably mounted which cooperates with the vertical web of the pull-out rail on the opposite side of the adjustment part to the vertical web of the body rail.

As a result of the configuration according to the invention, in the region of the rear end of the body rail an installation space is provided which extends substantially over the entire height of the body rail. Due to the configuration of the adjustment part in such a manner that the lateral guide roller also cooperates with the vertical web of the pull-out rail or an additional lateral guide roller is provided in the base body of the adjustment part which cooperates the with vertical web of the pull-out rail, the differential drawer slide according to the invention has an advantageous lateral stability in the closed position and over a first section of the pulling-out so that the pull-out furniture part guided by the differential drawer slide is stable with respect to a force acting in the sense of a rotation about a vertical axis. In addition, the running properties of the drawer slide are improved due to the reduction in friction.

Preferably the body rail and the drawer slide are the same length and in the closed position of the differential drawer slide end flush with one another both at their front end and at their rear end.

In an advantageous embodiment of the invention, a roller is rotatably mounted on the base body of the adjustment part which rolls at least starting from the closed state of the differential drawer slide over a first section of the pulling-out of the differential drawer slide between an upwardly directed track of the body rail and a downwardly directed track of the drawer slide and over this section of the pulling-out of the differential drawer slide a load can be transferred from the pull-out rail to the body rail. As a result, it is possible to dispense with a further auxiliary roller arranged between the differential roller and the adjustment part which rolls over a first section of the pulling out of the differential drawer slide between the upwardly directed track of the body rail and the downwardly directed track of the pull-out rail. In the case of drawer slides having short nominal lengths, the attachment of such an additional auxiliary roller with a shortened central rail is barely possible or not possible for space reasons. The roller of the adjustment part also could only cooperate with the upwardly directed track of the body rail and an additional roller could additionally be rotatably mounted on the base body of the adjustment part which, at least over a first section of the pulling-out of the differential drawer slide starting from the closed position of the differential drawer slide, cooperates with the downwardly directed track of the pull-out rail, wherein a load can be transferred from the pull-out rail to the body rail via the additional roller, the base body of the adjustment part and the roller.

Advantageously in the release position for lowering the rear end of the central rail with respect to the central rail, the adjustment part is pivotable about a horizontal pivot axis at right angles to the pull-out direction and in the locking position is blocked with respect to a pivoting about the pivot axis, wherein the pivot axis of the adjustment part is arranged further forward than the lateral guide roller of the adjustment part (13). For adjustment of the adjustment part between the release position and the locking position, it is preferably provided that the pivot axis of the adjustment part is displaceable with respect to the central rail. Here in the locking position of the adjustment part, the pivoting of the adjustment part about the pivot axis for lowering the rear end of the central rail is blocked by a retaining surface of the central rail and in the release position the adjustment part is disengaged from the retaining surface.

In an expedient embodiment of the invention, it is provided that if, in the release position of the adjustment part, the drawer slide starting from the open position is pushed together into the closed position, the adjustment part approaches an approach surface of the body rail with the result that the adjustment part is automatically displaced into the locking position.

When "front" and "rear" is mentioned in this document, this is related to the pull-out direction.

Further advantages and details of the invention are explained hereinafter with reference to the appended drawings. In the figures:

BRIEF DESCRIPTION OF THE DRAWINGS

FIGS. 13 and 14 show oblique views of the adjustment part from various viewing directions;

FIGS. 15 and 16 shows a side view and a plan view of the adjustment part;

FIG. 17 shows a plan view similar to FIG. 16 but without the roller of the adjustment part;

FIG. 18 shows a side view of the drawer slide in the closed position of the drawer slide;

FIG. 19 shows a section along the line A-A from FIG. 18;

FIG. 25 to 28 show diagrams similar to FIG. 13 to 16 for a second exemplary embodiment of the invention with a modified adjustment part;

FIG. 29 shows a section along the line C-C from FIG. 27;

FIG. 30 shows a section similar to FIG. 20 for this second exemplary embodiment of the invention;

FIG. 31 shows a section along the line D-D from FIG. 30.

DETAILED DESCRIPTION OF EXAMPLE EMBODIMENTS

A first exemplary embodiment of a differential drawer slide according to the invention is explained hereinafter with reference to FIGS. 1 to 24. The differential drawer slide is configured as a roller slide. In a roller slide, rollers which bring about the mutually displaceable guidance of the rails are mounted rotatably on the rails. The differential drawer slide comprises a body rail 3, a pull-out rail 1 and a central rail 2 arranged between the body rail 3 and the pull-out rail 1, wherein in the exemplary embodiment all the rollers are rotatably mounted on the central rail 2.

Figure 1:
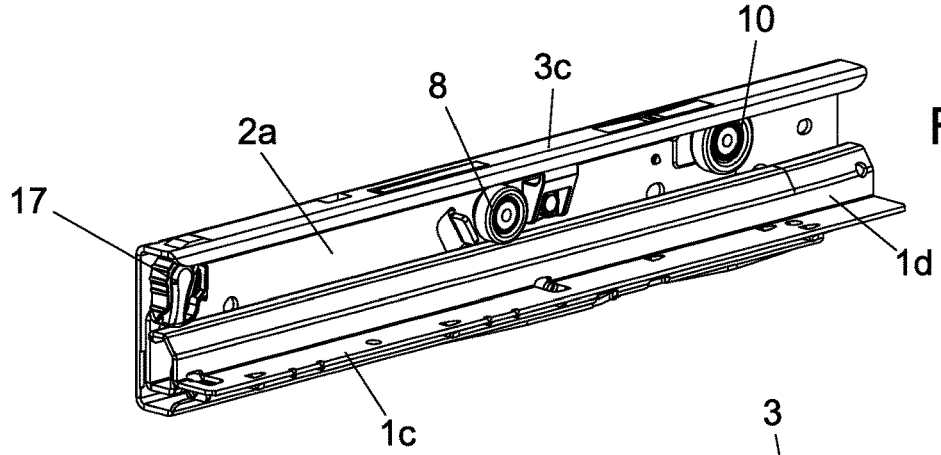
FIG. 1 shows an oblique view of an exemplary embodiment of a differential drawer slide according to the invention in the closed position of the drawer slide.
Figure 2:
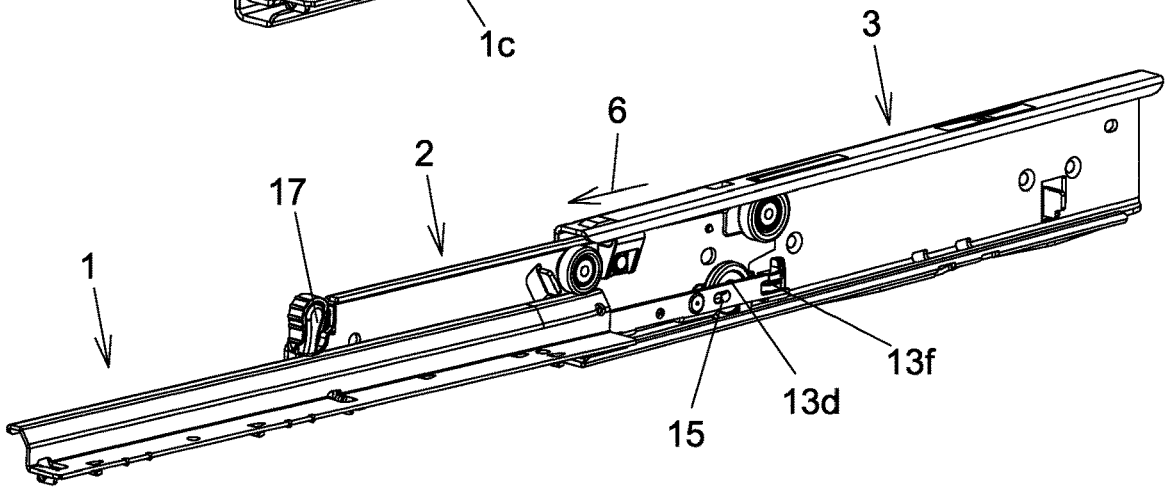
FIG. 2 shows the drawer slide in the open position.
Figure 3:
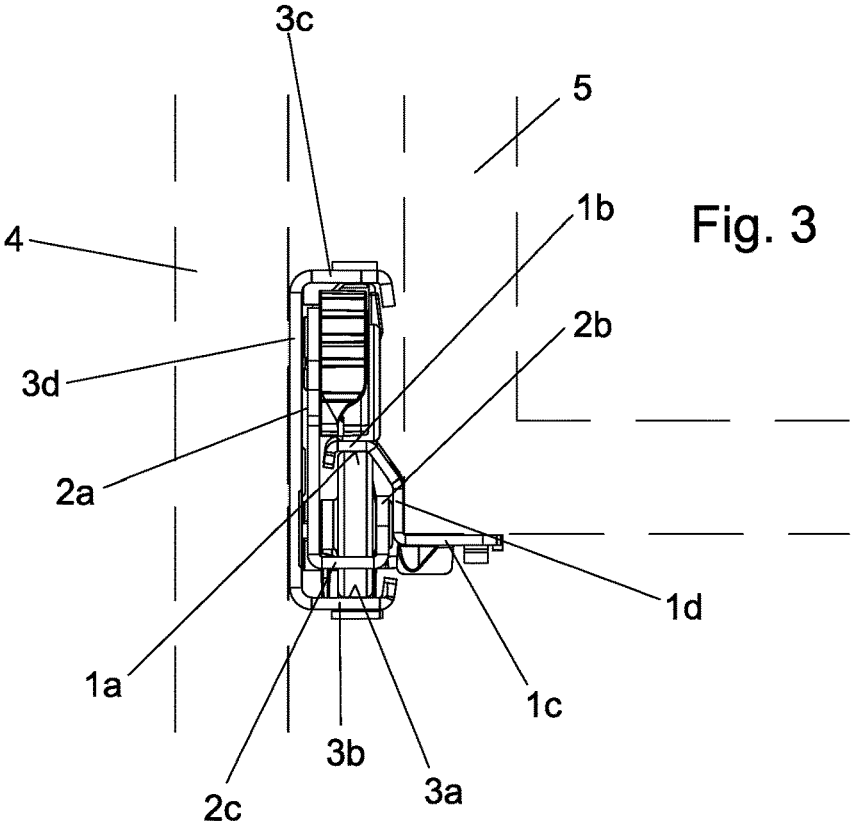
FIG. 3 shows a front-side view of the drawer slide.
Figure 4:
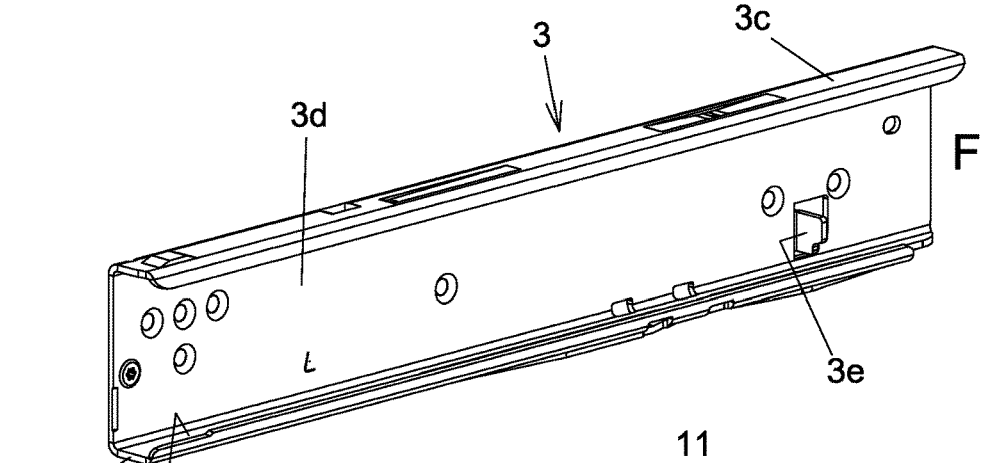
FIGS. 4 and 5 show oblique views of the body rail from various viewing directions.
Figure 5:
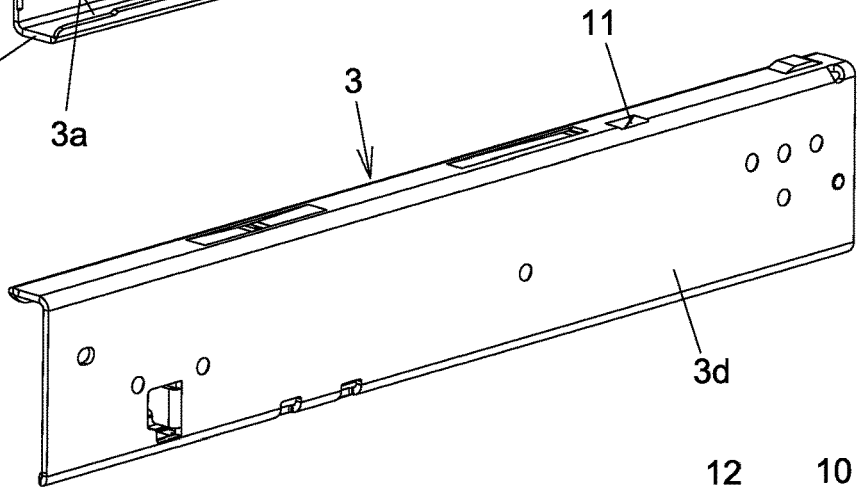
Figure 6:
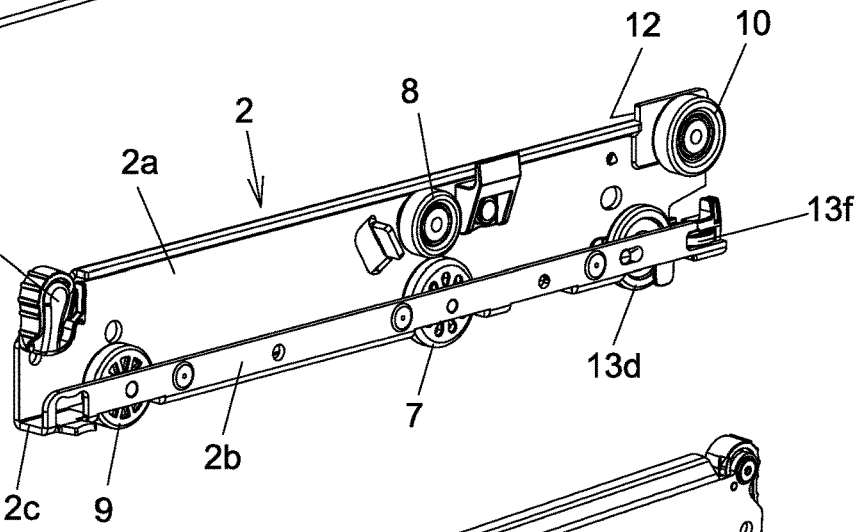
FIGS. 6 and 7 show oblique views of the central rail from various viewing directions.
Figure 7:
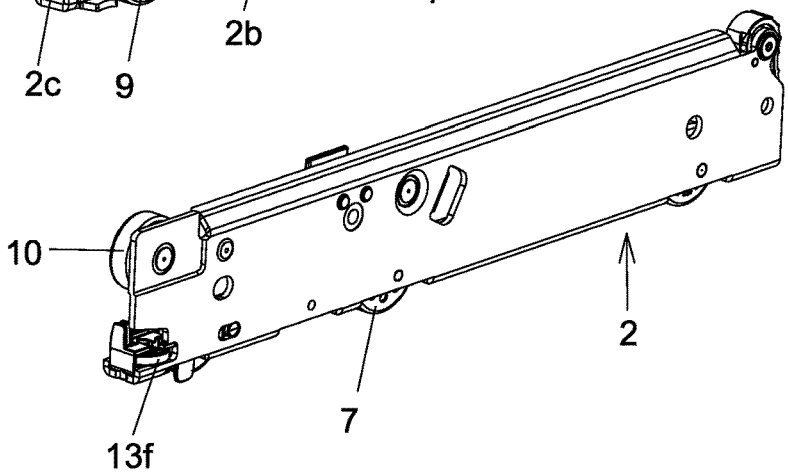
Figure 8:
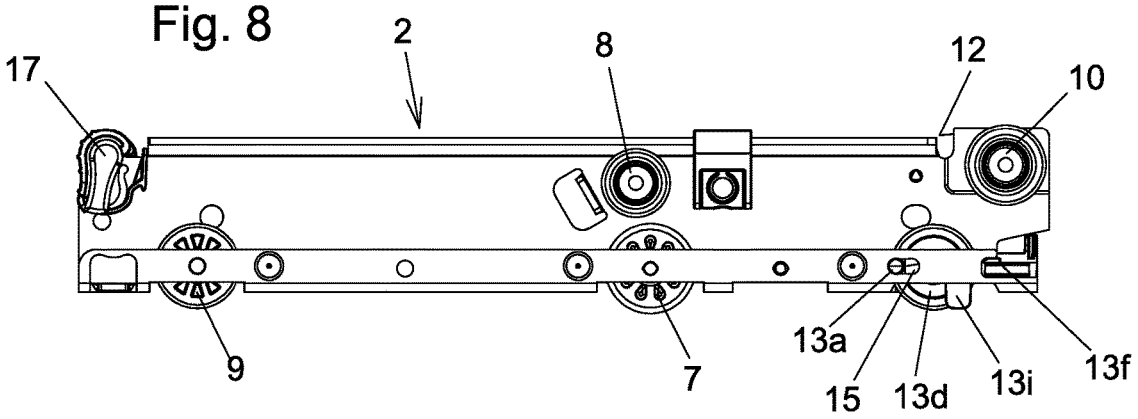
FIG. 8 shows a side view of the central rail in the locking position of the adjustment part.
Figure 9:
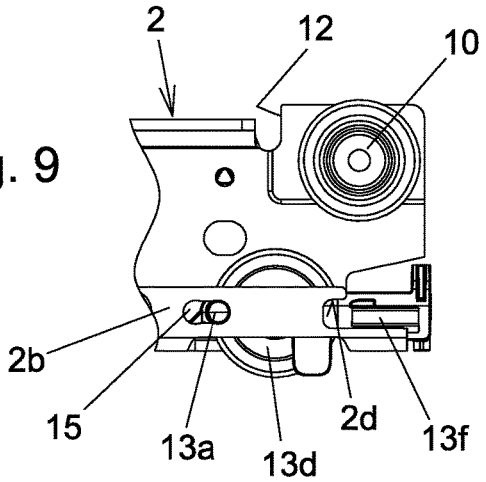
FIG. 9 shows a rear section of the central rail in side view in the release position of the adjustment part which has not yet pivoted.
Figure 10:
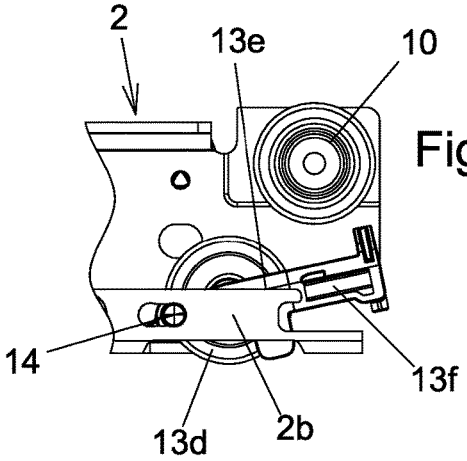
FIG. 10 shows a diagram similar to FIG. 9 in the release position of the pivoted adjustment part.
Figure 11:
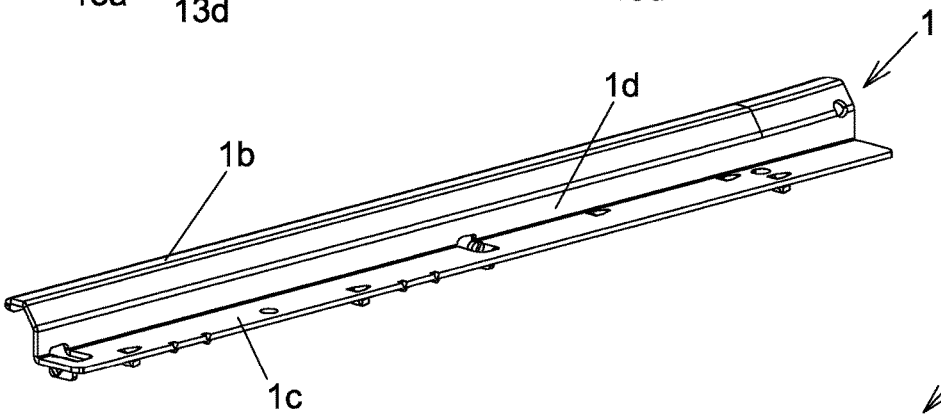
FIGS. 11 and 12 show oblique views of the pull-out rail from various viewing directions.
Figure 12:
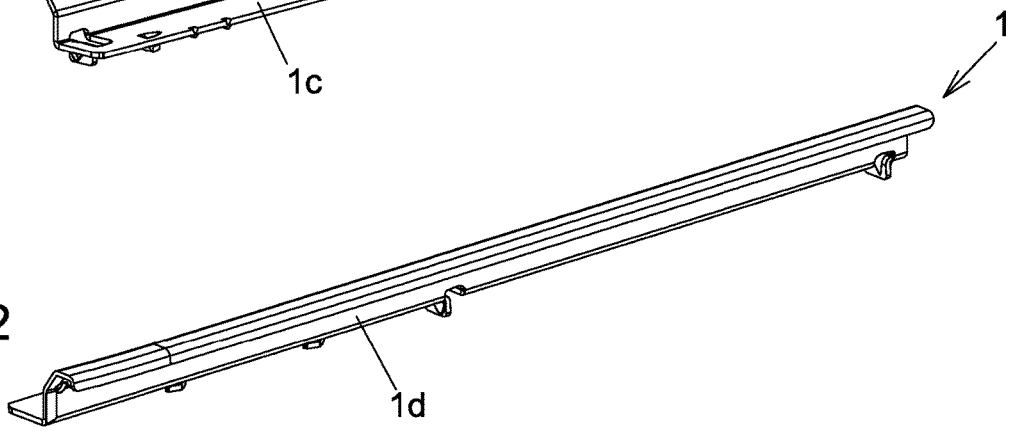
Figure 20:
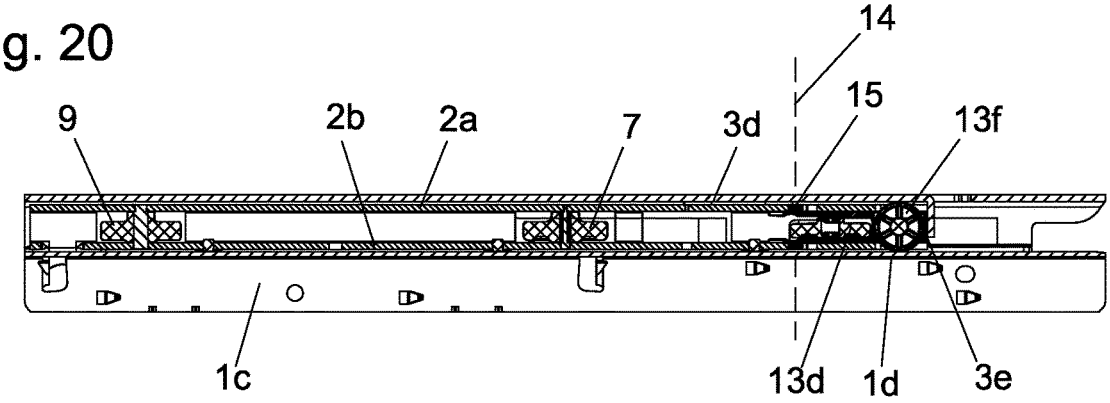
FIG. 20 shows a section along the line B-B from FIG. 18.

The body rail 3 is used for attachment to a furniture body 4 of which only a section is indicated by dashed lines in FIG. 3. The pull-out rail 1 is used for attachment to a pull-out furniture part 5, for example, a drawer of which only a section is indicated by dashed lines in FIG. 3.

In the exemplary embodiment the pull-out furniture part 5 rests on a lower horizontal web 1*c* of the pull-out rail 1, which is connected to the lower end of a vertical web 1*d* of the pull-out rail 1. The lower horizontal web 1*c* could also be omitted and the pull-out furniture part 5 could be attached to the vertical web 1*d*. A horizontal web 1*b* of the pull-out rail 1 is connected to the upper end of the vertical web 1*d*. When the lower horizontal web 1*b* is present, the lower horizontal web 1*c* and the horizontal web 1*b* rest on opposite sides of the vertical web 1*d*.

A body rail 3 has a vertical web 3*d* to which an upper horizontal web 3*c* and a lower horizontal web 3*b* are connected at the upper and lower end so that the body rail has a C-shaped cross-section.

The central rail 2 has a vertical web 2*a* on which rollers of the differential drawer slide are rotatably mounted. In the exemplary embodiment, the central rail additionally has a horizontal web 2*c* which on one side is connected to a lower end of the vertical web 2*a* and on the opposite side is connected to the lower end of a vertical section 2*b* of the central rail 2, whose height is less than half the height of the vertical web 2*a*.

The rails 1-3 are guided synchronously, i.e. when pulling out the pull-out rail 1 from the central rail 2 in a pull-out direction 6, the central rail 2 is displaced synchronously with respect to the body rail 3 in the pull-out direction 6. The central rail 2 in this cases covers respectively half the distance of the pull-out rail 1 with respect to the body rail 3.

When the differential drawer slide is completely pushed together, the closed position of the drawer slide is present in which the central rail 2 has an inserted position in which it is completely inserted into the body rail 3 and the pull-out rail 1 has an inserted position in which it is completely inserted into the central rail 2. When the drawer slide is completely pulled out, the open position of the drawer slide exists in which the central rail 2 has a pulled-out position in which it is completely pulled out from the body rail and the pull-out rail 1 has a pulled-out position in which it is completely pulled out from the central rail 2.

For synchronous guidance of the rails 1-3 a differential roller 7 is arranged rotatably on the central rail, which rolls between a downwardly directed track 1*a* of the pull-out rail 1 arranged on the underside of the horizontal web 1*b* of the pull-out rail and an upwardly directed track 3*a* of the body rail 3 arranged on the upper side of the lower horizontal web 3*b* of the body rail 3 and hereby transfers a part of the load of the pull-out rail 1 directly onto the body rail 3. The differential roller 7 has some play in the vertical direction. In the closed position of the drawer slide, the differential roller is located in the region of the longitudinal centre of the drawer slide.

In the region above the differential roller 7, the central rail 2 has a support roller 8 which is arranged somewhat offset towards the front with respect to the differential roller 7 in the exemplary embodiment and which is mounted rotatably on the vertical web 2*a* of the central rail 2 which, in the pulled-out position of the pull-out rail 1, can support the rear end of the pull-out rail 1 against tilting upwards.

In the exemplary embodiment, as already mentioned, all the rollers are arranged on the central rail 2 as is preferred in differential drawer slides. In particular, located in the region of the front end of the central rail 2 is a roller 9 which cooperates with the downwardly directed track 1*a* of the first rail 1 and in the inserted position of the second rail 2 cooperates with the upwardly directed track 3*a* of the third rail 3, and located in a rear region of the central rail 2 is a roller 10 which cooperates with a downwardly directed track of the body rail 3 arranged on the underside of an upper horizontal web 3*c* of the body rail 3.

The roller 10 is rotatably mounted on the vertical web 2*a* of the central rail 2. The differential roller 7 and the roller 9 are rotatably mounted between a lower section of the vertical web 2*a* and the vertical section 2*b* of the central rail 2 opposite this. The lower end of the vertical web 2*a* and the vertical section 2*b* are connected to opposite edges of the lower horizontal web 2*c* of the central rail 2. The lower section of the vertical web 2*a*, the lower horizontal web 2*c* and the vertical section 2*b* together form a U-shaped section of the central rail 2 when viewed in front-side view or when viewed in the cross-section of the central rail.

A stop element 11 of the body rail with which a stop surface 12 of the central rail 2 cooperates is used to limit the pulling out of the central rail 2 from the body rail 1 in the pulled-out position of the central rail 2. The stop element 11 of the body rail 3 is formed by a downwardly curved tongue stamped out from the upper horizontal web 3*c*. The stop surface 12 of the central rail 2 is formed by the front-side surface of a section of the vertical web 2*a* of the central rail 2 which protrudes upwards in the region of the rear end of the central rail 2. In the pulled-out position of the central rail 2 the stop surface 12 approaches the stop element 11, as can be seen from FIG. 24.

Furthermore, an adjustment part 13 is arranged on the central rail 2 which is explained in detail hereinafter and which, in a locking position, prevents the central rail 2 from being able to be tilted from a normal position whilst lowering its rear end, into a tilt position (cf. FIG. 21) in which the stop surface 12 can be guided past under the stop element 11.

Insertion of the central rail 2 into the pull-out rail 1 is limited by an approach surface 3*e* of the body rail 3 to which the adjustment part 13 approaches in the inserted position of the central rail 2, as will be explained in detail further below.

The pulling-out of the pull-out rail 1 from the central rail 2 and insertion of the pull-out rail 1 into the central rail 2 is also limited by stops, which are not the subject matter of this application and which are not explained further. Such stops are known, for example, from the initially mentioned prior art and can also be configured according to this previously known prior art. In the exemplary embodiment a securing part 17 is mounted rotatably about a horizontal axis at the front end of the central rail 2, which in the locking position shown in the figures, blocks any protrusion of the pull-out rail 1 from the central rail 2.

In a rear end section of the central rail 2 in a lower region of the central rail, the adjustment part 13 is mounted displaceably between a locking position (cf. FIGS. 1-3, 6-8, 23 and 24) and a release position (cf. FIGS. 9, 10, 21 and 22). In the release position the adjustment part 13 is pivotable about a horizontal pivot axis 14 located at right angles to the pull-out direction 6. In the locking position the pivoting of the adjustment part 13 about the pivot axis 14 is blocked. In the exemplary embodiment the pivot axis 14 is formed by axle journals 13*a* of the adjustment part 13, which are arranged on the outer sides of two forwardly protruding arms 13*b* of a base body 13*e* of the adjustment part 13. The axle journals 13*a* engage in elongate holes 15 of the central rail 2. The elongate holes 15 are arranged in opposite vertical sections of the central rail 2. One of these vertical sections in which one of the elongate holes 15 is arranged is formed by the lower section of the vertical web 2*a* of the central rail 2. The opposite elongate hole 15 is arranged in the vertical section 2*b* of the central rail.

The elongate holes 15 extend at least substantially in a horizontal direction parallel to the pull-out direction ("substantially" means in this connection a deviation of less than +/−10°). The axle journals 13*a* are displaceable in the elongate holes 15 with the result that the pivot axis 14 is also displaceable. If the axle journals 13*a* lie at the front end of the elongate holes 15, the adjustment part 13 is located in the locking position. If the axle journals lie at the rear ends of the elongate holes 15, the adjustment part 13 is located in the release position. In order to achieve an engagement of the axle journals in the locking position and in the release position, the elongate holes 15 preferably have constrictions in a central region.

In order to insert the axle journals 13*a* in the elongate holes 15 during assembly of the adjustment part 13, the arms 13*b* can be bent accordingly towards one another. In order to hold the axle journals 13*a* more securely in the elongate holes 15, at their front ends the arms 13*b* can be connected by a spring element which counteracts any pressing together.

When the rear end of the central rail 2 is pressed downwards, the adjustment part 13 located in the locking position is supported at a contact point 13*c* on the upwardly directed track 3*a* of the lower horizontal web 3*b* of the body rail 3. This contact point 13*c* is formed in the exemplary embodiment by the respectively lowest point of a roller 13*d* of the adjustment part 13 mounted rotatably on the base body 13*e* of the adjustment part 13, as is preferred.

The roller 13*d* is arranged in the intermediate space between the arms 13*b*. The lower horizontal web 2*c* of the central rail 2 has a cut-out in the region of the roller 13*d*.

In the case of larger lengths of the differential drawer slide, the depicted embodiment could also be modified to the effect that an additional auxiliary roller is mounted rotatably on the central rail 2 in the region between the differential roller and the adjustment part 13, which cooperates with the same tracks as the differential roller 7. Such auxiliary rollers are known in conventional differential drawer slides. In this case, the roller 13*d* mounted rotatably on the adjustment part could also be omitted. Instead of the contact point 13*d* formed by the lowest point of the roller, the lower end of a contact section 13*i* of the base body 13*e* would then form such a contact point. The base body 13*e* shown in the exemplary embodiment can therefore be used as shown with roller 13*d* and also in applications without roller 13*d*.

In the locking position of the adjustment part 13, the adjustment part is blocked from pivoting about the pivot axis 14 so that the contact point 13*c* moves upwards by a retaining surface 2*d* of the central rail 2. This retaining surface 2*d* is formed in the exemplary embodiment by an extension of the vertical section 2*b* of the central rail 2 which projects towards the rear and lies above the base body 13*e* of the adjustment part 13.

For example, for blocking the pivotability of the adjustment part 13, the contact section 13*i* could also have a forwardly projecting projection which cooperates with a projection of the central rail which protrudes in the region next to the roller 13*d* from the lower end of the vertical section 2*b* in the direction of the roller 13*d*, which forms the retaining surface.

If the adjustment part is moved from the locking position into the release position, whereby the axle journals 13 are moved rearwards in the elongate holes 15, the base body 13*e* becomes disengaged from the retaining surface 2*d* (i.e. to lie behind this). A pivoting of the adjustment part about the pivot axis 14 whilst raising the contact point 13*c* is therefore enabled. Thus, the central rail 2 can be tilted from its normal position which it adopts in the locking position of the adjustment part 13 into a tilt position in which the rear end of the central rail 2 is lowered with respect to the normal position.

Figure 21:
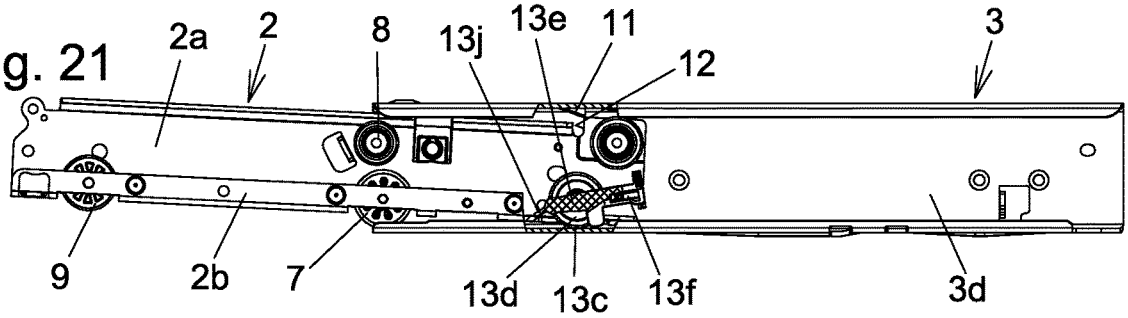
FIG. 21 shows the body rail and the central rail of the drawer slide during insertion of the central rail into the body rail, wherein the central rail is tilted into the tilt position, the rails in the region of the adjustment part are cut open.
Figure 22:
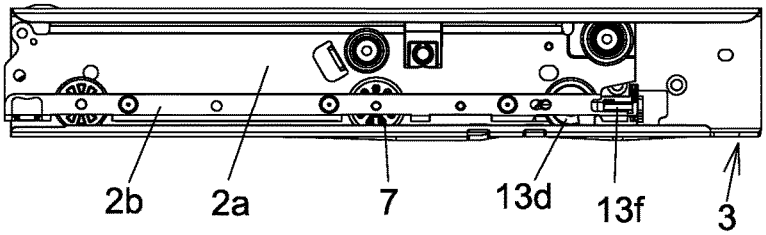
FIG. 22 shows the central rail further inserted into the body rail, wherein the adjustment part is still located in the release position and specifically approaches the approach surface of the body rail.
Figure 23:
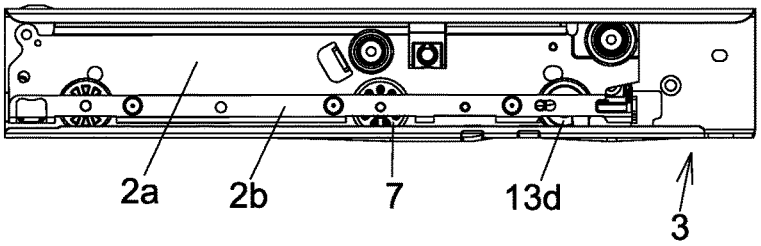
FIG. 23 shows the central rail retracted into the inserted position, wherein the adjustment part is adjusted into the locking position.

In FIG. 23 the normal position of the central rail 2 is shown with the adjustment part 13 located in the locking position. In FIG. 22 the adjustment part is moved into the release position but the central rail is still located in the normal position. In FIG. 21 the central rail is tilted (=pivoted) into the tilt position.

The tilting (=pivoting) of the central rail 2 from the normal position into the tilt position is accomplished about the axis of rotation of the differential roller 7. Since the pivot axis 14 of the adjustment part 13 is located further forwards than the contact point 13*c* of the adjustment part 13 on the track 3*a*, an opposite pivoting of the adjustment part takes place when tilting the central rail 2 from the normal position into the tilt position.

During this pivoting of the adjustment part 13, tongue-shaped spring elements 13*j* of the base body 13*e* come to rest against the section of the lower horizontal web 2*c* of the central rail 2 located in front of the cut-out for the roller 13*d* and are elastically deflected. These spring elements 13*j* therefore bring about a restoring force on the adjustment part 13 in the sense of a pivoting back into the position in which it can be moved into the locking position. At least one spring element for restoring the pivoted adjustment part could also be configured in a different manner.

If the central rail 2 is pushed into the body rail 3 when the adjustment part 13 is located in the release position, shortly before reaching the inserted position of the central rail 2, the base body 13*e* of the adjustment part 13 approaches the approach surface 3*e* of the body rail 3, cf. FIG. 22. If the central rail 2 is inserted further into the inserted position, the adjustment part 13 is displaced into the locking position by the approach surface 3*e*, cf. FIG. 23. In the exemplary embodiment the approach surface 3*e* is formed by a bent lobe punched out from the vertical web 3*d*.

The roller 13*d* of the adjustment part 13 rolls over a first section of the pulling-out of the differential drawer slide starting from the closed position of the differential drawer slide between the upwardly directed track 3*a* of the body rail and the downwardly directed track 1*a* of the pull-out rail 1. When a section of the pull-out rail 1 located behind the differential roller 7 is sufficiently strongly loaded, a load can thereby be transferred directly from the pull-out rail 1 to the body rail 3 via the roller 13*e*. In this case, the roller 13*d* takes over the function of an auxiliary roller arranged between the differential roller and the rear end of the body rail in conventional differential drawer slides, which is omitted here.

The central rail 2 is configured to be shorter than the body rail 3 and shorter than the pull-out rail 1 and in the closed state of the differential drawer slide, the rear end of the central rail is offset towards the front with respect to the rear end of the body rail 3 and with respect to the rear end of the pull-out rail 1. This can be seen particularly well from FIG. 18.

As a result, in the region of the rear end of the body rail an installation space is thereby formed in which a self-retracting device can be arranged. Such a self-retracting device 16 integrated in the differential drawer slide is shown highly schematically by dashed lines in FIG. 18.

Self-retracting devices for drawer slides, including those integrated in the drawer slide are known and usual. Such self-retracting devices usually have a spring-loaded tilt slider. When pulling out the drawer slide, starting from the closed position of the drawer slide, this is adjusted from a base position which the tilt slider adopts in the closed position of the drawer slide, contrary to the spring force of an entrainer arranged on the pull-out rail, into a waiting position. In this waiting position the entrainer of the pull-out rail decouples from this by a tilting of the tilt slider and the tilt slider remains in the waiting position by resting on a retaining surface of the self-retracting device. If the pull-out rail is pushed in again, the entrainer of the pull-out rail couples onto the tilt slider and tilts this, with the result that the tilt slider is released from the retaining surface. Consequently the spring-loaded tilt slider pulls the pull-out rail into the inserted position. This process can be damped by a damper.

In the exemplary embodiment the pull-out rail 1 and the body rail 3 are the same length as is preferred and in the closed position of the differential drawer slide end flush with one another both at their front ends and at their rear ends. It would also be feasible and possible that the body rail 3 is configured to be shorter than the pull-out rail 1 and in the closed position of the drawer slide is offset towards the front with respect to the rear end of the drawer slide.

In the closed position of the differential drawer slide the distance a of the rear end of the central rail 2 from the rear end of the body rail 3 is preferably more than 5% of the length of the body rail 3, particularly preferably more than 10%. In the exemplary embodiment the distance a is about 15% of the length of the body rail 3.

On the base body 13*e* of the adjustment part 13, a lateral guide roller 13*f* is mounted rotatably about a vertical axis. This lateral guide roller 13*f* cooperates on one side of the adjustment part 13 with the vertical web 3*d* of the body rail 3 and on the opposite side of the adjustment part 13 with the vertical web 1*d* of the pull-out rail 1 (cf. in particular FIGS. 19 and 20). A good lateral stability of the drawer slide is thereby achieved despite the shorter configuration of the central rail 2 even in the closed position of the drawer slide and over a first section of the pulling out of the drawer slide. If an attempt is made to twist a furniture part that can be pulled out from the differential drawer slide in the closed position of the differential drawer slide or in the region of a first section of the pulling-out of the differential drawer slide about a vertical axis, such a twisting by the differential drawer slide according to the invention is counteracted by a high resistance force. In addition, due to a reduction in friction the running properties of the drawer slide are improved.

The first section of the pulling-out of the differential drawer slide over which the lateral guide roller cooperates both with the vertical web 3*d* of the body rail 3 and also with the vertical web 1*d* of the pull-out rail 1, is preferably 10% to 30% of the total pull-out section.

Insertion of the central rail 2 removed from the body rail 3 into the body rail 3 is explained hereinafter with reference to FIGS. 21-23 (in this figure the securing part 17 on the central rail is not shown). The adjustment part 13 is initially adjusted into the release position. As a result, the central rail 2 is pivoted into the tilt position and introduced with its rear end into the intermediate space between the horizontal webs 3*b*, 3*c* of the body rail, whereby the adjustment part 13 is pivoted about the pivot axis 14. FIG. 21 shows the state when the stop surface 12 of the central rail 2 has been passed through under the stop element 11 of the body rail 3. As a result, the central rail 2 can be tilted (=twisted about the axis of the differential roller 7) into its normal position whilst lowering its front end, i.e. lifting its rear end and then inserted further into the body rail 3. FIG. 22 specifically shows the state in which the base body 13*e* approaches the approach surface 3*e* of the body rail 3. This is the case shortly before reaching the inserted position of the central rail 2. If the central rail is now inserted completely into the inserted position, the adjustment part 13 adjusted from the approach surface 3*e* into the locking position, cf. FIG. 23. This adjustment of the adjustment part 13 from the release position into the locking position is therefore accomplished independently when inserting the central rail into the inserted position.

Figure 24:
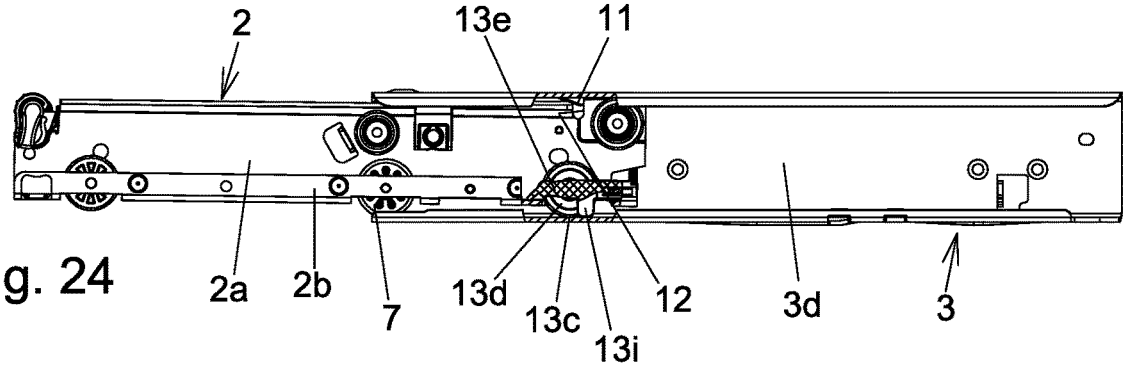
FIG. 24 shows the central rail extended into the pulled-out position wherein the adjustment part is located in the locking position and the stop surface of the central rail abuts against the stop element of the body rail, the rails are cut open in the region of the adjustment part.

If the central rail 2 is subsequently withdrawn again, in the pulled-out position of the central rail the stop surface 12 of the central rail 2 approaches the stop element 11 of the body rail 3 with the result that any further pulling-out of the central rail 2 is blocked, cf. FIG. 24.

If the central rail 2 is subsequently to be completely removed from the body rail 3 again, the central rail 2 is pulled out into the pulled-out position according to FIG. 24 and the adjustment part 13 is adjusted into the release position. The central rail 2 can now be tilted from the normal position into the tilt position according to FIG. 21 (=twisted or pivoted about the axis of the differential roller). The stop surface 12 of the central rail 2 can be guided under the stop element 11 of the body rail 3, whereupon the central rail 2 can be removed completely from the body rail 3.

A second exemplary embodiment of the invention with a modified adjustment part is explained hereinafter with reference to FIGS. 25-31. Apart from the differences described in the following, the configuration corresponds to that of the first exemplary embodiment and the description of the first exemplary embodiment and the modifications described therein can be used similarly in this respect.

The roller 13*d* of the adjustment part 13 is configured to be smaller here and only cooperates with the upwardly directed track 3*a* of the lower horizontal web 3*b* of the body rail 3. For this purpose an additional roller 13*g* is mounted rotatably on the base body 13*e* of the adjustment part 13 about a horizontal axis at right angles to the pull-out direction 6. This only cooperated with the downwardly directed track 1*a* of the horizontal web 1*b* of the pull-out rail 1. In this exemplary embodiment, the possible load transfer from the pull-out rail 1 to the body rail 3 via the adjustment part 13 is therefore accomplished via the additional roller 13*g*, the base body 13*e* and the roller 13*d*.

In this exemplary embodiment the lateral guide roller 13*f* is configured to be smaller and only cooperates with the vertical web 3*d* of the body rail 3, cf. in particular FIGS. 30 and 31. For this purpose, an additional lateral guide roller 13*h* is provided which only cooperates with the vertical web 1*d* of the pull-out rail 1. This can be seen in particular from FIGS. 30 and 31. If in the closed position of the drawer slide and in a first section of the pulling-out of the drawer slide, a force directed in the direction of the body rail 3 acts on the rear end of the pull-out rail 1, this force is transmitted via the lateral guide roller 13*f*, the base body 13*e* and the additional lateral guide roller 13*h* onto the vertical web 3*d* of the body rail 3.

The first section of the pulling-out of the differential drawer slide over which the additional lateral guide roller 13*h* cooperates with the vertical web 1*d* of the pull-out rail 1 is preferably 10% to 30% of the total pull-out section.

A mixed form between the first and the second exemplary embodiment could also be implemented, i.e. the adjustment part 13 could comprise a roller 13*d* which cooperates with the opposite tracks of the pull-out rail and body rail and a lateral guide roller and additional lateral guide roller, of which one cooperates with the vertical web of the body rail and the other cooperates with the vertical web of the pull-out rail or the adjustment part could comprise a roller and an additional roller of which one cooperates with the track of the body rail and the other cooperates with the track of the pull-out rail, as well as a lateral guide roller which both cooperate with the vertical web of the body rail and with the vertical web of the pull-out rail.

The invention claimed is:

1. A differential drawer slide for furniture parts that can be pulled out, comprising a body rail that can be attached to a furniture body, a pull-out rail that can be attached to a pull-out furniture part and a central rail arranged between the body rail and the pull-out rail, wherein the pull-out rail and the central rail can be pulled out starting from a closed position of the differential drawer slide into an open position of the differential drawer slide in a pull-out direction and the pulling out of the central rail from the body rail in the open position of the differential drawer slide is limited by a stop element of the body rail to which a stop surface of the central rail approaches, wherein on the central rail in the region of the rear end of the central rail an adjustment part is mounted adjustably between a release position in which the central rail can be tilted with respect to the body rail about a horizontal axis located at right angles to the pull-out direction of the central rail from a normal position into a tilt position in which its rear end is lowered with respect to the normal position and for removal of the central rail from the body rail, the stop surface of the central rail can be guided past the body rail under the stop element of the body rail, and a locking position in which the central rail is blocked from any tilting from the normal position into the tilt position, and wherein a lateral guide roller is rotatably mounted on a base body of the adjustment part, which lateral guide roller cooperates with a vertical web of the body rail, wherein the central rail is configured to be shorter than the body rail and shorter than the pull-out rail and in the inserted state of the differential drawer slide, the rear end of the central rail is offset towards the front with respect to the rear end of the body rail and with respect to the rear end of the pull-out rail and that the lateral guide roller of the adjustment part cooperates with a vertical web of the pull-out rail on the side of the adjustment part opposite to the vertical web of the body rail or that on the base body of the adjustment part, an additional lateral guide roller is additionally rotatably mounted which cooperates with the vertical web of the pull-out rail on the side of the adjustment part opposite to the vertical web of the body rail.

2. The differential drawer slide according to claim 1, wherein the central rail has a rotatably mounted load-transmitting differential roller which has some play in the vertical direction with respect to the central rail and rolls from inserted up to pulled-out state of the differential drawer slide between an upwardly directed track of the body rail and a downwardly directed track of the pull-out rail.

3. The differential drawer slide according to claim 2, wherein a roller is rotatably mounted on the base body of the adjustment part, which rolls at least over a first section of the pulling-out of the differential drawer slide starting from the closed position of the differential drawer slide between the upwardly directed track of the body rail and the downwardly directed track of the pull-out rail and by means of which a load can be transferred from the pull-out rail to the body rail or a roller and an additional roller are rotatably mounted on the base body of the adjustment part, of which the roller cooperates with the upwardly directed track of the body rail and the additional roller cooperates with the downwardly directed track of the pull-out rail at least over a first section of the pulling-out of the differential drawer slide starting from the closed position of the differential drawer slide, wherein via the additional roller, the base body and the roller, a load can be transferred from the pull-out rail to the body rail.

4. The differential drawer slide according to claim 1, wherein in the release position the adjustment part is pivotable about a horizontal pivot axis at right angles to the pull-out direction for lowering the rear end of the central rail with respect to the central rail and in the locking position is blocked from any pivoting about the pivot axis.

5. The differential drawer slide according to claim 4, wherein for adjustment of the adjustment part, the pivot axis of the adjustment part is displaceable between the locking position and the release position with respect to the central rail, wherein in the locking position of the adjustment part for blocking the pivotability of the adjustment part, the base body of the adjustment part is in engagement with a retaining surface of the central rail.

6. The differential drawer slide according to claim 5, wherein when pushing together the pull-out guide starting from the open position into the closed position when the adjustment part is located in the release position, the adjustment part approaches an approach surface of the body rail which displaces the adjustment part into the locking position.

7. The differential drawer slide according to claim 5, wherein the adjustment part has two forwardly projecting arms on the sides of which directed away from one another, respectively one axle journal is arranged, wherein these axle journals forming the pivot axis of the adjustment part engage in elongate holes which are arranged in opposite vertical sections of the central rail.

8. The differential drawer slide according to claim 1, wherein during a pivoting of the adjustment part whilst lowering the rear end of the central rail at least one spring element is elastically deflected and brings about a restoring force on the adjustment part in the sense of a pivoting back into the position in which the adjustment part can be adjusted into the locking position.

9. The differential drawer slide according to claim 3, wherein in the region of the central rail located behind the differential roller only the roller of the adjustment part cooperates with the upwardly directed track of the body rail.

10. The differential drawer slide according to claim 1, wherein the central rail has all the rollers of the pull-out guide.

* * * * *